United States Patent [19]

Nakajima et al.

[11] 4,111,170

[45] Sep. 5, 1978

[54] AIR-FUEL RATIO CONTROL SYSTEM

[75] Inventors: Masao Nakajima, Atsugi; Kenji Masaki; Mitsumasa Inoue, both of Yokohama, all of Japan

[73] Assignee: Nissan Motor Company, Limited, Japan

[21] Appl. No.: 762,720

[22] Filed: Jan. 26, 1977

[30] Foreign Application Priority Data

Jan. 30, 1976 [JP] Japan ..... 51-9031

[51] Int. Cl.[2] ..... F02B 33/00

[52] U.S. Cl. ..... 123/119 EC; 123/32 EE; 123/32 EA; 123/124 R; 123/124 B

[58] Field of Search ..... 123/119 EC, 32 EE, 32 EA, 123/32 AE, 124 B; 60/276, 285

[56] References Cited

U.S. PATENT DOCUMENTS 4,010,722 3/1977 Laprade ..... 123/124 R
4,057,042 11/1977 Aono ..... 123/32 EE

FOREIGN PATENT DOCUMENTS 2,444,695 4/1975 Fed. Rep. of Germany .... 123/119 EC

*Primary Examiner*—Ronald H. Lazarus
*Attorney, Agent, or Firm*—Robert E. Burns; Emmanuel J. Lobato; Bruce L. Adams

[57] ABSTRACT

Air drawn into a carburetor main fuel passage for adjustment of the air-fuel ratio of an engine air-fuel mixture is either stepwise or continuously prevented from being undesirably increased with increases in the engine load by either closing an additional passage for the air at an engine load above a predetermined value or continuously reducing the effective cross sectional area of a variable orifice in a passage or an additional passage for the air with increases in the engine load.

17 Claims, 11 Drawing Figures

AIR-FUEL RATIO CONTROL SYSTEM

BACKGROUND OF THE INVENTION

1. Field of the Invention

The present invention relates generally to an air-fuel ratio control system for adjusting the air-fuel ratio of an air-fuel mixture formed for an internal combustion engine to a predetermined or desired value and particularly to an air-fuel ratio control system of this type which is improved to stepwise or continuously reduce the effective cross sectional area of a passage, causing air to be drawn into a main fuel passage of a carburetor of the engine, with increases in the load of the engine to a desirable value at which the control range of the controlled air-fuel ratio is maintained at a desirable value.

2. Description of the Prior Art

As is well known in the art, an air-fuel ratio control system for an internal combustion engine is constructed and arranged to control the air-fuel ratio of an air-fuel mixture formed for the engine to a predetermined or desired air-fuel ratio by controlling, in accordance with the concentration of a component contained in exhaust gas of the engine which concentration is representative of the air-fuel ratio of an air-fuel mixture burned in the engine, the flow of air drawn into a main and/or slow fuel passage of a carburetor of the engine to adjust the flow the fuel drawn from the main and/or slow fuel passage into an intake passageway of the engine. It is necessary or desirable that the flow of the air drawn is so controlled that the control range of the controlled air-fuel ratio is maintained at a predetermined value independently of the load of the engine. However, in a conventional air-fuel ratio control system the flow of the air drawn into the main fuel passage has been undesireably or excessively increased with increases in the load of the engine so that the control range of the controlled air-fuel ratio has been increased to an undesirable or excessive value with increases in the engine load.

SUMMARY OF THE INVENTION

It is, therefore, an object of the invention to provide an air-fuel ratio control system improved to prevent the flow of air drawn into the main fuel passage from being undesirably increased with increases in the engine load so that the control range of the controlled air-fuel ratio is maintained at a predetermined or desirable value.

This object is accomplished by providing an additional passage in parallel with a fuel flow control passage which causing air to be drawn into the main fuel passage therethrough and a flow control valve for closing the additional passage at a suitable load of the engine higher than a light load or a flow control valve for continuously reducing the effective cross sectional area of the additional passage with increases in the engine load. Alternatively, the object is accomplished by providing a flow control valve for continuously reducing the effective cross sectional area of the fuel flow control passage, or by communicating the fuel flow control passage upstream of a flow control valve therefor with a venturi formed in an intake passageway of the engine.

BRIEF DESCRIPTION OF THE DRAWINGS

This and other features and advantages of the invention will become more apparent from the following detailed description taken in conjunction with the accompanying drawings in which.

DESCRIPTION OF THE PREFERRED EMBODIMENT

Figure 1:
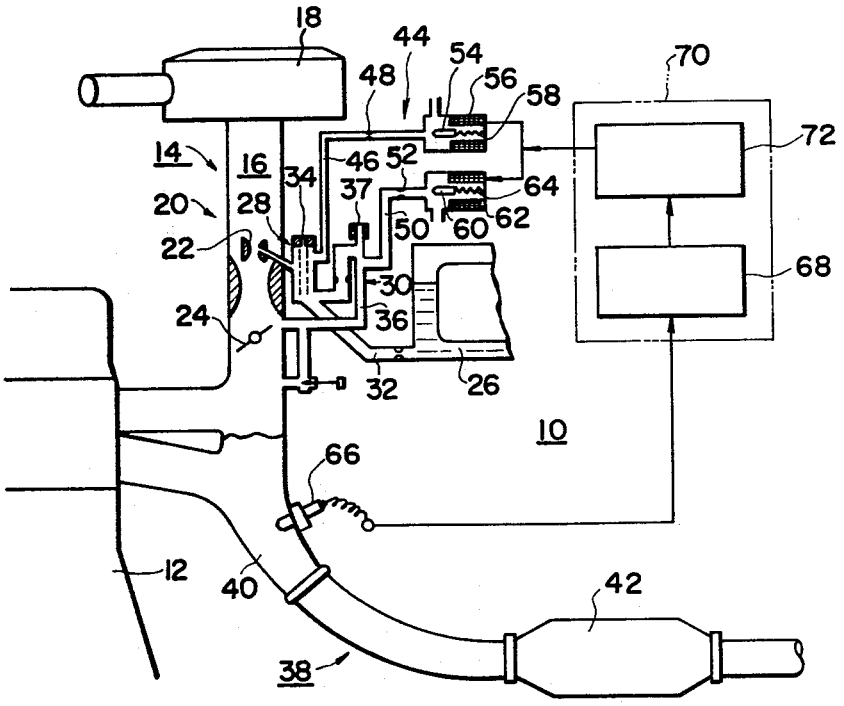
FIG. 1 is a schematic view of a conventional air-fuel ratio control system as per the introduction of the present specification.

Referring to FIG. 1 of the drawings, there is shown a prior art air-fuel ratio control system 10 as per the introduction of the instant specification which is combined with an internal combustion engine 12. The engine 12 includes an intake system 14 including an intake passageway 16 providing communication between the engine 12 and the atmosphere through an air cleaner 18 to conduct air into the engine 12, and a carburetor 20 having a part of the intake passageway 16. The intake passageway 16 has a venturi 22 formed therein and a throttle valve 24 rotatably mounted in the intake passageway 16 downstream of the venturi 22. The carburetor 20 has a fuel bowl 26, a main system 28 opening into the venturi 22 and a slow system 30 opening into the intake passageway 16 both adjacent to and upstream of the throttle valve 24 which is in its fully closed position. The main system 28 has a main fuel passage 32 communicating with the fuel bowl 26, and an air bleed 34 communicating with the fuel passage 32. The slow system 30 has a slow fuel passage 36 branching off from the fuel passage 32 of the main system 28, and an air bleed 37 communicating with the fuel passage 36. The engine 12 also includes an exhaust system 38 including an exhaust gas passageway 40 providing communication between the engine 12 and the atmosphere to conduct exhaust gases of the engine 12 to the atmosphere, and an exhaust gas purifying device 42 located in the exhaust gas passageway 40 to convert noxious component elements contained in the engine exhaust gases to harmless matters. The exhaust gas purifying device 42 may be a catalytic converter including a ternary or three-way catalyst which concurrently catalytically effects both oxidation of hydrocarbons (HC) and carbon monoxide (CO) in the engine exhaust gases and reduction of nitrogen oxides ($NO_x$) therein.

The air-fuel ratio control system 10 comprises a fuel flow control device 44 combined with the carburetor 20. The fuel flow control device 44 comprises a first fuel flow control passage 46 which provides communication between the atmosphere and the fuel passage 32 and is formed therein with an orifice 48 for metering the flow of air drawn thereinto, and a second fuel flow control passage 50 which provides communication between the atmosphere and the fuel passage 36 and is formed therein with an orifice 52 for controlling the flow of air drawn thereinto. A first flow control valve 54 is provided for controlling the flow of air drawn into the fuel passage 32 through the first passage 46 and includes a solenoid 56 for, when energized, electromagnetically moving the flow control valve 54 into a position in which the flow control valve 54 opens the passage 46 in this example. A spring 58 is provided for, when the solenoid 56 is deenergized, moving the flow control valve 54 into a position in which the flow control valve 54 closes the passage 46 in this example. A second flow control valve 60 is provided for controlling the flow of air drawn into the fuel passage 36 through the second passage 50 and includes a solenoid 62 for, when energized, electromagnetically moving the flow control valve 60 into a position in which the flow control valve 60 opens the passage 50 in this example. A spring 64 is provided for, when the solenoid 62 is deenergized, moving the flow control valve 60 into a position in which the flow control 60 closes the passage 50 in this example. When the first passage 46 is opened by the flow control valve 54 while the main system 28 is in action or operative, additional air is drawn into the fuel passage 32 through the first passage 46 to reduce the amount of fuel drawn from the fuel passage 32 into the intake passageway 16 by the share of the drawn additional air. As a result, the air-fuel ratio of an air-fuel mixture provided by the main system 28 is increased. On the contrary, when the first passage 46 is closed by the flow control valve 54, additional air is prevented from being drawn into the fuel passage 32 through the first passage 46 to increase the amount of fuel drawn from the fuel passage 32 into the intake passageway 16 by the share of the additional air. As a result, the air-fuel ratio of the air-fuel mixture provided by the main system 28 is reduced. Similarly, when the second passage 50 is opened by the flow control valve 60 while the slow system 30 is in action or operative, additional air is drawn into the fuel passage 36 through the second passage 50 so that the air-fuel ratio of an air-fuel mixture provided by the slow system 30 is increased. On the contrary, when the second passage 50 is closed by the flow control valve 60, the air-fuel ratio of the air-fuel mixture provided by the slow system 30 is reduced.

Figure 2:
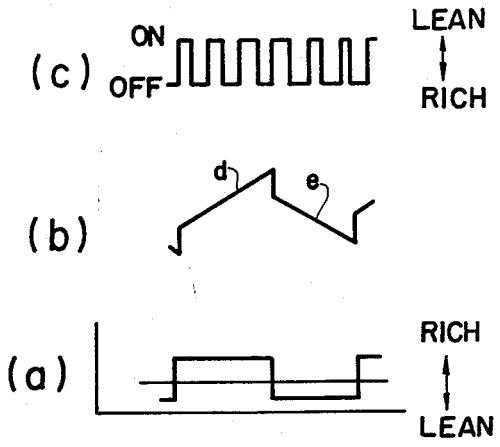
FIG. 2 is diagrams of examples of three kinds of control signals produced in an electric control circuit forming part of the air-fuel ratio control system shown in FIG. 1.

The air-fuel ratio control system 10 also includes a sensor 66 located in the exhaust gas passageway 40 upstream of the exhaust gas purifying device 42 and sensing the air-fuel ratio of an air-fuel mixture provided for and burned in the engine 12. The sensor 66 may be, for example, a sensor which senses the concentration of a component such as, for example, oxygen ($O_2$) contained in the engine exhaust gas which concentration is representative of a function of the air-fuel ratio of the air-fuel mixture burned in the engine 12. The oxygen sensor comprises, for example, zirconium oxide. The sensor 66 generates an output signal having a value such as, for example, a voltage which is representative of the sensed concentration of the component as shown in FIG. 2(*a*) of the drawings. The sensor 66 is electrically connected to a controller 68 of a control device 70 to supply the output signal to the controller 68. The controller 68 compares the output signal of the sensor 66 representative of the sensed air-fuel ratio with a reference signal representative of a set or desired air-fuel ratio and generates first and second control or command output signals *d* and *e* as shown in FIG. 2(*b*) of the drawings when the sensed air-fuel ratio is lower and higher than the desired air-fuel ratio, respectively, as shown in FIG. 2(*a*). The controller 68 is electrically connected to a pulse generating circuit 72 to feed the command signal thereto. The pulse generating circuit 72 is electrically connected to said solenoids 56 and 62 to supply to same electric signals for energizing and deenergizing to vary the ratio of open time of the flow control valves 54 and 60 to their closed time in accordance with the sensed air-fuel ratio. When the sensed air-fuel ratio is below the desired air-fuel ratio, the pulse generating circuit 72 generates in response to the command signal *d* of the controller 68 pulse signals for increasing the ratio of open time of the flow control valves 54 and 60 to their closed time to increase the flow of air drawn into the fuel passages 32 and 36 through the first and second passages 46 and 50. As a result, the flow of fuel drawn from the fuel passages 32 and 36 into the intake passageway 16 is reduced to increase the air-fuel ratio of the air-fuel mixture provided by the carburetor 20 to the desired air-fuel ratio. In this instance, each of the pulse signals has a broad pulse width as shown in the left portion of FIG. 2(*c*). When the sensed air-fuel ratio is above the desired air-fuel ratio, the pulse generating circuit 72 generates in response to the command signal *e* of the controller 68 pulse signals for reducing the ratio of open time of the flow control valves 54 and 60 to their closed time to reduce the flow of air drawn into the fuel passages 32 and 36 through the first and second passages 46 and 50. As a result, the flow of fuel drawn from the fuel passages 32 and 36 into the intake passageway 16 is increased to reduce the air-fuel ratio of the air-fuel mixture formed by the carburetor 20 to the desired air-fuel ratio. In this instance, each of the pulse signals has a narrow pulse width as shown in the right portion of FIG. 2(*c*).

Figure 3:
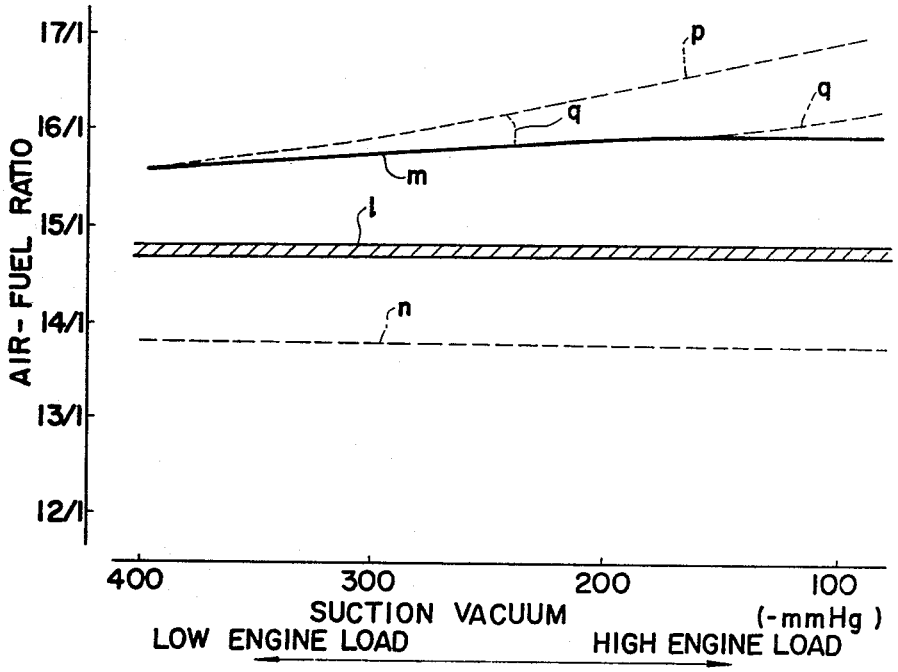
FIG. 3 is a graphic representation of the relationship between desirable and undesirable values of the control range of the controlled air-fuel ratio and the load of the engine.

Referring to FIG. 3 of the drawings, there is shown the relationship between the control range of the air-fuel ratio controlled by supplying additional air into the fuel passage 32 through the orifice 48 and the load of the engine 12. In FIG. 3, the desired air-fuel ratio is indicated by the solid line *l* and allowable upper and lower limits of the air-fuel ratio controlled by supply of the additional air and interruption of supply of the additional air are indicated by the solid line *m* and the dotted line *n*. A desirable value of the control range of the air-fuel ratio controlled by supply of the additional air is represented by the difference between the allowable upper limit and the allowable lower limit. The allowable upper and lower limits and accordingly the control range of the air-fuel ratio controlled by supply of the additional air depend on the size or cross sectional area or diameter of the orifice 48 and the sizes of an orifice (no numeral) of the air bleed 34 and a fuel jet (no numeral) of the main fuel passage 32. Furthermore, owing to fluid resistance of the orifice 48 and owing to the general and inherent property of the carburetor 20 that as the amount of air drawn into the engine 12 is increased, the amount of an emulsion of air and fuel drawn from the main and slow systems 28 and 30 into the intake passageway 16 is increased, the amount of additional air drawn into the fuel passage 32 through the orifice 48 is increased and reduced with increases and decreases in the load of the engine 12.

It is desirable or necessary that the control range of the air-fuel ratio controlled by supply of and interruption of supply of the additional air is maintained at the desirable value independently of the load of the engine 12. The orifice 48 is sized to allow additional air which maintains the control range of the controlled air-fuel ratio at the desirable value to pass therethrough at a light load of the engine 12 at which load the main system 28 starts to be in action, by making the size of the orifice 48, for example, equal to or greater than that of the orifice of the air bleed 34. When the orifice 48 has a size smaller than the above-mentioned size, the amount of additional air drawn through the orifice 48 is undesirably reduced to reduce the control range of the controlled air-fuel ratio to an undesirable value below the desirable value at the light load of the engine 12. When the orifice has the above-mentioned size, the amount of additional air drawn through the orifice 48 is excessively increased as the engine load is increased above the light load to increase the control range of the controlled air-fuel ratio to an excessively great value, as shown by the dotted curve *p* in FIG. 3.

Figure 4:
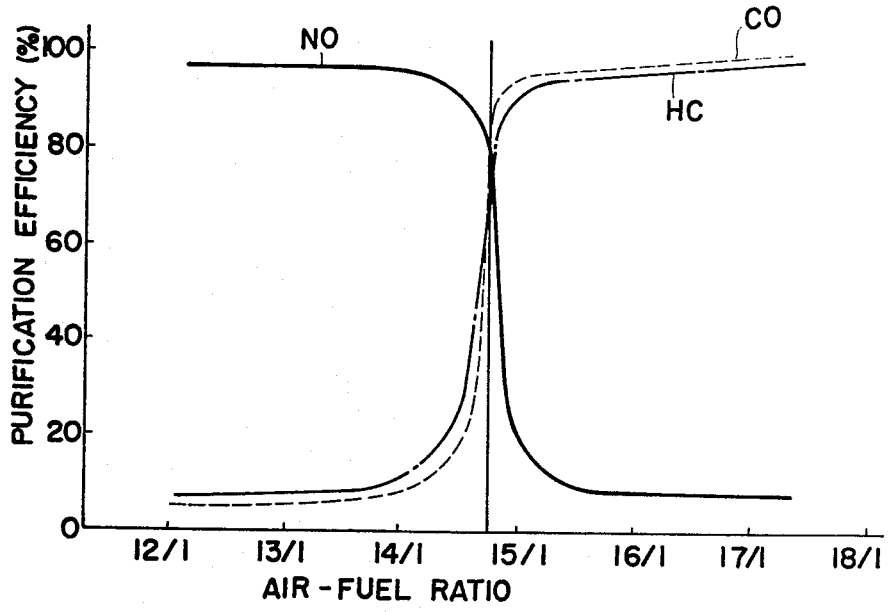
FIG. 4 is a graphic representation of the relationship between the air-fuel ratio and the ratio of the concentration of three components contained in engine exhaust gases treated by a catalytic converter to the concentration of the components in the engine exhaust gases at the time prior to the entrance into the catalytic converter.

Referring to FIG. 4 of the drawings, there is shown the relationship between the air-fuel ratio of an air-fuel mixture provided for the engine 12 and the efficiency (%) of purification of or reduction in hydrocarbons (HC), carbon monoxide (CO) and nitrogen oxides (NOx) contained in the engine exhaust gases in the exhaust gas purifying device 42. As be apparent from FIG. 4, when the air-fuel ratio is increased above the desired stoichiometric air-fuel ratio, although hydrocarbons and carbon monoxide are satisfactorily reduced, the efficiency of purification of nitrogen oxides is strikingly reduced. When the air-fuel ratio is reduced below the desired stoichiometric air-fuel ratio, although nitrogen oxides are satisfactorily reduced, the efficiency of purification of hydrocarbons and carbon monoxide is strikingly reduced. Accordingly, it is necessary the control range of the air-fuel ratio controlled is maintained at the desired value.

Figure 5:
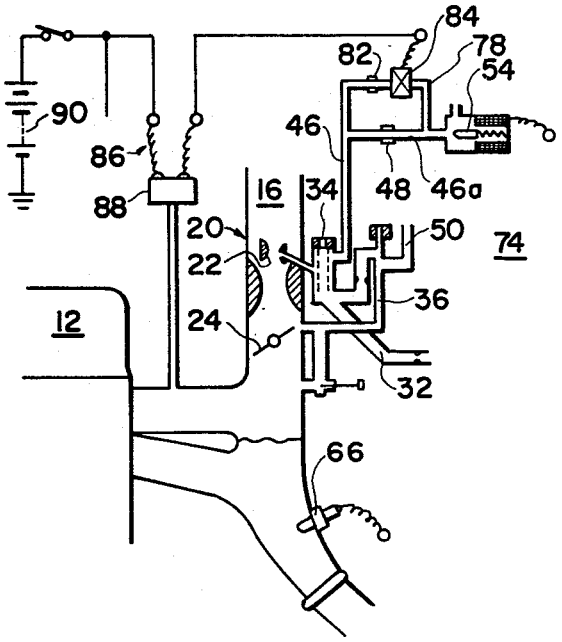
FIG. 5 is a schematic view of a first preferred embodiment of an air-fuel ratio control system according to the invention.

Referring to FIG. 5 of the drawings, there is shown a first preferred embodiment of an air-fuel ratio control system according to the invention. In FIG. 5, component elements and parts similar to those shown in FIG. 1 are designated by the same reference numerals as those used in FIG. 1 and the illustration of some similar component elements and parts is omitted for purpose of simplicity. The air-fuel ratio control system, generally designated by the reference numeral 74, is characterized in that an additional passage 78 is provided to bypass or to be arranged in parallel with that portion 46*a* of the passage 46 which is formed with the orifice 48. The additional passage 78 is formed therein with an orifice 82. The size of the orifice 82 is larger than that of the orifice 48 and the sizes of the orifices 48 and 82 are so selected that the orifices 48 and 82 allow atmospheric air to be drawn into the fuel passage 32 threrethrough which air makes the control range of the controlled air-fuel ratio into the desirable value as shown by the solid line *m* in FIG. 3 at the light load of the engine 12 at which the main system 28 starts to be in action. A flow control value 84 is provided in the passage 78 to control the flow of additional air passing therethrough and includes means such as a solenoid (not shown) for electromagnetically operating the control valve 84. Control means 86 is provided for causing the operating means to open and close the control valve 84 in response to the loads of the engine 12 lower and higher than a predetermined value, respectively. The control means 86 includes sensing means 88 communicating with the intake passageway 16 downstream of the throttle valve 24 and responsive to a vacuum in the intake passageway 16 below and above a predetermined value which is, for example, within the range of 200 to 210 mmHg to generate first and second output signals. The sensing means 88 is electrically connected to an electric power source 90 and to the operating means to supply the first and second output signals thereto. The operating means causes the control valve 84 to open and close the passage 78 in response to the first and second output signals from the sensing means 88, respectively. By closing the passage 78 by the control valve 84, the amount of additional air drawn through the passage 46 is stepwise prevented from being undesirably increased or is stepwise returned to a desirable value to temporarily restore the control range of the controlled air-fuel ratio to the desirable value at the predetermined value of the engine load. As a result, the amount of additional air drawn into the fuel passage 32 is prevented from being excessively increased at higher loads of the engine 12 and the pattern of the relationship between the control range of the controlled air-fuel ratio and the load of the engine 12 has a stepped or lacerate shape as shown by the dotted line *q* in FIG. 3.

Figure 6:
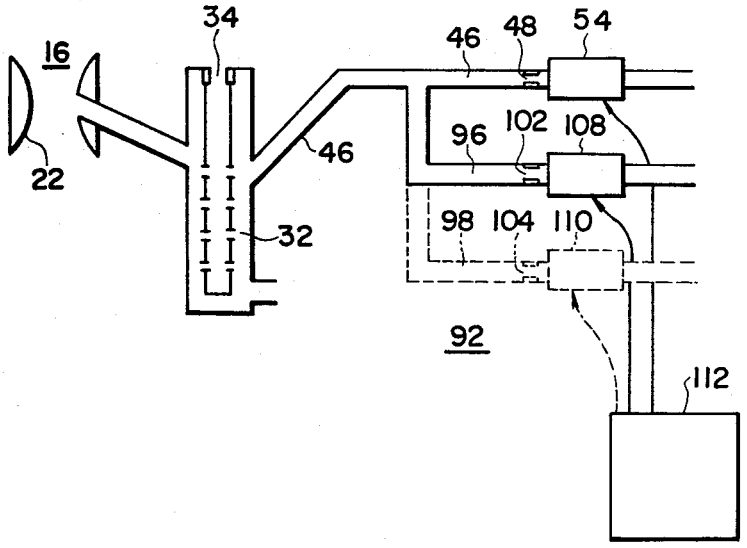
FIG. 6 is a schematic view of a second preferred embodiment of an air-fuel ratio control system according to the invention.

Referring to FIG. 6 of the drawings, there is shown a second preferred embodiment of an air-fuel ratio control system according to the invention. In FIG. 6, similar component elements and parts to those shown in FIGS. 1 and 5 are designated by the same reference numerals as those used in FIGS. 1 and 5 and the illustration of some similar component elements and parts is omitted for purpose of simplicity. The air-fuel ratio control system, generally designated by the reference numeral 92, is characterized in that two additional passages 96 and 98 are branched off from the passage 46 downstream of the control valve 54. Each of the passages 96 and 98 communicates with the atmosphere and which are formed therein with orifices 102 and 104, respectively. The orifices 48, 102 and 104 are sized to allow additional air to be drawn therethrough which air provides the control range of the controlled air-fuel ratio equal to the desirable value at a light load of the engine 12 at which the main system 28 starts to be in action. Flow control valves 108 and 110 such as the flow control valve 54 are provided for opening and closing the passages 96 and 98, respectively to control the flows of additional air passing therethrough into the fuel passage 32. Each of the flow control valves 54, 108 and 110 includes operating means (not shown) such as the solenoid 56 and the return spring 58 for operating the corresponding flow control valve 54, 108 or 110. A control device 112 such as the control device 70 shown in FIG. 1 is electrically connected to the respective solenoids of the flow control valves 54, 108 and 110. The control device 112 causes the operating means of each of the flow control valves 54, 108 and 110 to cyclically open and close the corresponding flow control valve 54, 108 or 110 so that the ratio of the open time of the corresponding control valve 54, 108 or 110 to the closed time thereof is increased and reduced in accordance with air-fuel ratios, sensed by the sensor 66, below and above the desired air-fuel ratio, respectively similarly as described with reference to FIG. 1. The cyclical opening and closing operations of the flow control valve 54 are effected throughout all operations of the engine 12. The cyclical opening and closing operations of the flow control valves 108 and 110 are effected in sychronism with the operation of the control valve 54 and only when the load of the engine is below predetermined values, respectively which are different from each other. The control unit 112 also functions to cause the operating means of the flow control valve 108 only to continuously close the flow control valve 108 in response to a load of the engine 12 above a predetermined value such as, for example, a medium load. The control unit 112 also functions to cause the operating means of the flow control valve 110 only to continuously close the flow control valve 110 in response to a load of the engine 12 above a predetermined value such as, for example, a high load. Thus, the amount of additional air drawn through the passage 46 and undesirably increased with increases in the engine load is stepwise returned to a desirable value at medium and high loads of the engine 12 to temporarily restore the control range of the controlled air-fuel ratio to the desirable value so that the control range of the controlled air-fuel ratio is prevented from being excessively increased to an excessive value as shown by the curve *p* in FIG. 3.

Referring to FIGS. 7 to 11 of the drawings, there is shown five preferred embodiments of an air-fuel ratio control system according to the invention in which system the amount of additional air drawn into the fuel passage 32 through the passage 46 is continuously prevented from being undesirably increased with increases in the engine load to maintain the control range of the controlled air-fuel ratio at the desirable value as shown by the solid line *m* in FIG. 3. In FIGS. 7 to 11, component elements and parts similar to those shown in FIGS. 1, 5 and 6 are designated by the same reference numerals as those used in FIGS. 1, 5 and 6 and the illustration of some similar components elements and parts are omitted for purpose of simplicity.

Figure 7:
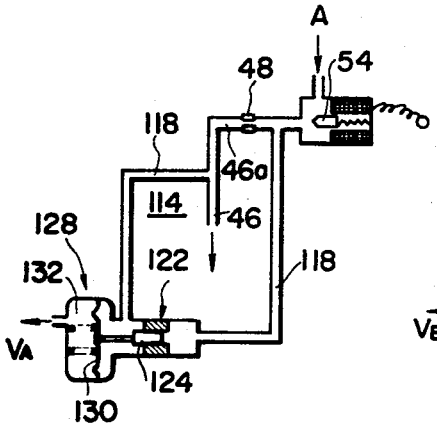
FIGS. 7 and 8 are schematic views of third and fourth preferred embodiments of an air-fuel ratio control system according to the invention.

The air-fuel ratio control system shown in FIG. 7, generally designated by the reference numeral 114, is characterized in that an additional passage 118 is provided in parallel with that portion 46*a* of the passage 46 which is formed with the orifice 48, similarly to the system 74 shown in FIG. 5. The additional passage 118 is formed therein with a variable orifice 122. A flow control valve 124 is provided for continuously varying the effective cross sectional area of the orifice 122 and comprises a needle valve slidably located in the orifice 122. A diaphragm unit 128 is provided for operating the flow control valve 124 and comprises a flexible diaphragm 130 having on a side thereof a vacuum chamber 132 communicating with the intake passageway 16 downstream of the throttle valve 24. The diaphragm 130 is so operatively connected to the flow control valve 124 that the effective cross sectional area of the orifice 122 or the clearance between the orifice 122 and the flow control valve 124 is reduced by the flow control valve 124 with decreases in the vacuum in the intake passageway 16 downstream of the throttle valve 24, that is, with increases in the engine load, and the orifice 122 is fully closed by the flow control valve 124 at a high or maximum load of the engine 12. Thus, the control range of the controlled air-fuel ratio is continuously converged into the desirable value throughout operations of the engine 12.

Figure 8:
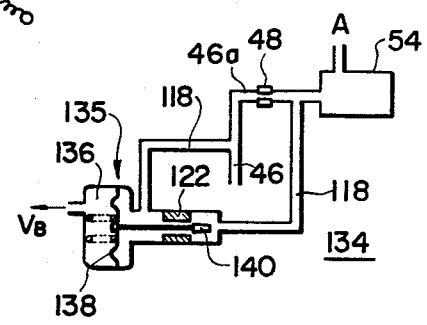

The air-fuel ratio control system shown in FIG. 8, generally designated by the reference numeral 134, is characterized in that it comprises a vacuum chamber 136 communicating with a venturi (no numeral) formed in the intake passageway 16, in lieu of the vacuum chamber 132 of FIG. 7. In FIG. 8, like component elements are designated by the same reference numerals as those used in FIG. 7. In this instance, a flexible diaphragm 138 is so operatively connected to a flow control valve 140 that the effective cross sectional area of the orifice 122 or the clearance between the orifice 122 and the flow control valve 140 is reduced by the flow control valve 140 with increases in the vacuum in the venturi.

Figure 9:
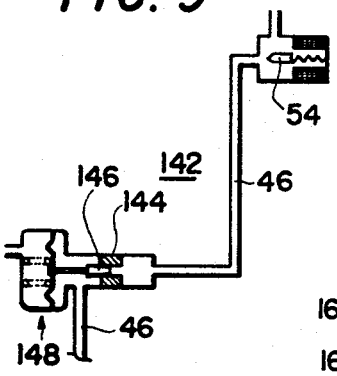
FIG. 9 is a schematic view of a fifth preferred embodiment of an air-fuel ratio control system according to the invention.

The air-fuel ratio control system shown in FIG. 9, generally designated by the reference numeral 142, is characterized in that the passage 46 is formed therein with an orifice 144 in lieu of the orifice 48 of FIG. 1, and that the effective cross sectional area of the orifice 144 is continuously reduced with increases in the load of the engine 12 by a flow control valve 146 analogous to the flow control valve 124 shown in FIG. 7 and operated by a diaphragm unit 148 analogous to the diaphragm unit 128 of FIG. 7. In this instance, the orifice 144 is not closed by the flow control valve 146 even at the maximum load of the engine 12 so that the control range of the controlled air-fuel ratio is maintained at the desirable value as shown by the line *m* in FIG. 3. A flow control valve and a diaphragm unit analogous respectively to the flow control valve 140 and the diaphragm unit 135 shown in FIG. 8 may be employed in lieu of the flow control valve 146 and the diaphragm unit 148.

Figure 10:
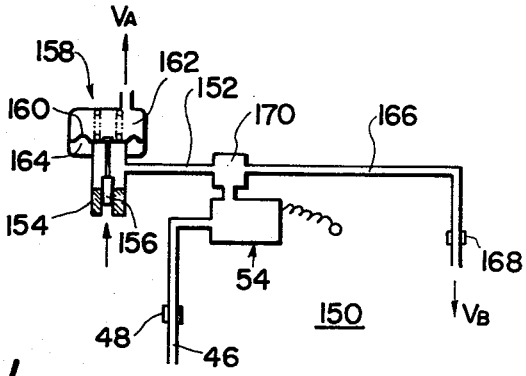
FIG. 10 is a schematic view of a sixth preferred embodiment of an air-fuel ratio control system according to the embodiment.

The air-fuel ratio control system shown in FIG. 10, generally designated by the reference numeral 150, is characterized in that the flow of air drawn into the passage 46 downstream of the flow control valve 54 is controlled by both the intake suction and the venturi vacuum of the engine. In FIG. 10, an additional passage 152 is provided which extends from the passage 46 upstream of the flow control valve 54. The additional passage 152 is provided with a variable orifice 154 the effective cross sectional area of which is variable by a flow control valve 156 and through which the passages 46 and 152 communicates with the atmosphere. The flow control valve 156 includes a diaphragm unit 158 having a flexible diaphragm 160 and first and second fluid chambers 162 and 164 separated from each other by the diaphragm 160. The second fluid chamber 164 communicates with the atmosphere through the orifice 154 and with a venturi (not shown) formed in the intake passageway 16 through the passage 152, a passage 166 and an orifice 168. The first fluid chamber 162 communicates with the intake passageway 16 downstream of the throttle valve 24. The diaphragm 160 is so operatively connected to the flow control valve 156 that the flow control valve 156 provides an effective cross sectional area of the orifice 154 causing air to be drawn which air makes the control range of the controlled air-fuel ratio into the desirable value when the engine 12 is running at its light load at which the intake suction is high and the venturi vacuum is low. The flow control valve 15 reduces the effective cross sectional area of the orifice 154 to prevent air drawn therethrough from being undesirably increased to continuously maintain the control range of the controlled air-fuel ratio at the desirable value as shown by the solid line *m* in FIG. 3 as the load of the engine 12 is increased, that is, as the intake suction is reduced and the venturi vacuum is increased. A pressure regulating chamber 170 is provided for preventing the pressure in the passage 46 downstream of the flow control valve 54 from pulsating. If the pressure pulsation does not take place, the pressure regulating chamber 170 may be omitted.

The control range of the controlled air-fuel ratio can be continuously controlled to the desirable value as shown by the solid line *m* in FIG. 3 by modifying the air-fuel ratio control system 150 shown in FIG. 10 to communicate the second fluid chamber 164 with the intake passageway 16 downstream of the throttle valve 24 and the first fluid chamber 162 with the venturi formed in the intake passageway 16.

Figure 11:
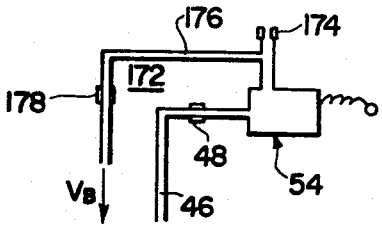
FIG. 11 is a schematic view of a seventh preferred embodiment of an air-fuel ratio control system according to the invention.

The air-fuel ratio control system shown in FIG. 11, generally designated by the reference numeral 172, is characterized in that air drawn through the passage 46 is prevented from being undesirably increased by directly employing the vacuum in a venturi (not shown) formed in the intake passageway 16. In FIG. 11, an orifice 174 is formed in the passage 46 upstream of the flow control valve 54 and the passage 46 communicates with the atmosphere through the orifice 174. The size of the orifice 174 is larger than that of the orifice 48. An additional passage 176 is provided which communicates with the passage 46 between the flow control valve 54 and the orifice 174 and with the venturi in the intake passageway 16 and which is formed with an orifice 178. By the expediment thus described, air drawn into the fuel passage 32 through the passage 46 is desirably reduced with increases in the venturi vacuum and accordingly the engine load to maintain the control range of the controlled air-fuel ratio to the desired value as shown by the solid line *m* in FIG. 3 independently of the engine load.

It will be thus appreciated that the invention provides an improved air-fuel ratio control system in which an additional flow control valve either closes at an engine load above a predetermined value an additional passage for causing air to be drawn into a carburetor main fuel passage for adjustment of the air-fuel ratio of an engine air-fuel mixture or continuously reduces the effective cross sectional area of a variable orifice in a passage or an additional passage for the air with increases in the engine load so that the air drawn into the main fuel passage is prevented from being undesirably increased with increases in the engine load to either stepwise or continuously adjust the control range of the controlled air-fuel ratio to a desired value and accordingly the efficiency of reducing burnable components in engine exhaust gases in an exhaust gas purifying device is improved at all load conditions of the engine.

What is claimed is:

1. An air-fuel ratio control system for an internal combustion engine, comprising means for sensing the concentration of a component contained in exhaust gas of said engine which concentration is representative of a function of the air-fuel ratio of an air-fuel mixture burned in said engine, said sensing means having means for generating an output signal representative of the sensed concentration of said component;

means defining a first passage communicating with the atmosphere and causing atmospheric air to be drawn into a main fuel passage of a main system of a carburetor of said engine;

a first flow control valve for controlling the flow of atmospheric air drawn into said main fuel passage through said first passage;

means defining a second passage communicating with the atmosphere and causing atmospheric air to be drawn into a slow fuel passage of a slow system of said carburetor;

a second flow control valve for controlling the flow of atmospheric air drawn into said slow fuel passage through said second passage;

first control means causing, in accordance with said output signal of said sensing means, said first and second flow control valves to vary the flow of air drawn into said main and slow fuel passages through said first and second passages to adjust the flow of fuel drawn from said main and slow fuel passages into said intake passageway to adjust the air-fuel ratios of air-fuel mixtures formed by said main and slow systems to a desired air-fuel ratio, respectively; and air flow control means cooperating with said first passage and for preventing the flow of air drawn into said main fuel passage through said first passage from being undesirably increased with increases in the load of said engine.

2. An air-fuel ratio control system as claimed in claim 1, in which said air flow control means comprises an additional passage bypassing a portion of said first passage downstream of said first flow control valve and formed therein with an orifice, an additional control valve for opening and closing said additional passage in accordance with the load of said engine, and control means for causing said additional control valve to open said additional passage in response to a load of said engine below a predetermined value and to close said additional passage in response to a load of said engine above said predetermined value.

3. An air-fuel ratio control system as claimed in claim 1, in which said air flow control means comprises a first additional passage branching off from said first passage downstream of said first flow control valve and communicating with the atmosphere and formed therein with an orifice, and a first additional flow control valve for controlling the flow of air passing through said first additional passage, said first control means comprises means for causing in accordance with said output signal of said sensing means and in synchronism with the operation of said first flow control valve when the load of the engine is below a first predetermined value, said first additional flow control valve to vary the flow of air passing through said first additional passage to adjust the flow of fuel drawn from said main fuel passage into said intake passageway, and means for causing said first additional flow control valve to close said first additional passage in response to a load of said engine above said first predetermined value.

4. An air-fuel ratio control system as claimed in claim 3, in which said air flow control means further comprises a second additional passage branching off from said first passage downstream of said first flow control valve and communicating with the atmosphere and formed therein with an orifice, and a second additional flow control valve for controlling the flow of air passing through said second additional passage, said first control means comprises means for causing, in accordance with said output signal of said sensing means and in synchronism with the operation of said first flow control valve when the load of the engine is below a second predetermined value, said second additional flow control valve to vary the flow of air passing through said second additional passage to adjust the flow of fuel drawn from said main fuel passage into said intake passageway, and means for causing said second additional flow control valve to close said second additional passage in response to a load of said engine above said second predetermined value.

5. An air-fuel ratio control system as claimed in claim 1, in which said air flow control means comprises an additional passage bypassing a portion of said first passage downstream of said first flow control valve and formed therein with a variable orifice;

an additional flow control valve for continuously varying the effective cross sectional area of said variable orifice; and a diaphragm unit for operating said additional flow control valve in accordance with the load of said engine; said diaphragm unit comprises a flexible diaphragm having on a side thereof a fluid chamber into which a fluid pressure representative of a function of the load of said engine is delivered, said diaphragm being so operatively connected to said additional flow control valve that said additional flow control valve continuously varies the effective cross sectional area of said variable orifice in accordance with variations in the pressure of said fluid in said fluid chamber.

6. An air-fuel ratio control system as claimed in claim 1, in which said air flow control means comprises a variable orifice formed in said first passage downstream of said first flow control valve;

an additional flow control valve for continuously varying the effective cross sectional area of said variable orifice; and a diaphragm unit for operating said additional flow control valve in accordance with the load of said engine and comprises a flexible diaphragm having on a side thereof a fluid chamber in which a fluid pressure representative of a function of the load of said engine is delivered; said diaphragm being so operatively connected to said additional flow control valve that said additional flow control valve continuously varies the effective cross sectional area of said variable orifice in accordance with variations in the pressure of said fluid in said fluid chamber.

7. An air-fuel ratio control system as claimed in claim 1, in which said air flow control means comprises an additional passage extending from said first passage upstream of said first flow control valve and communicating with the atmosphere, a variable orifice formed in said additional passage and through which said additional passage communicates with the atmosphere, an additional flow control valve for continuously varying the effective cross sectional area of said variable orifice, and a diaphragm unit for operating said additional flow control valve in accordance with the load of said engine and comprises a flexible diaphragm having on both sides thereof first and second fluid chambers into which first and second fluid pressures representative of functions of the load of said engine are delivered, respectively, said diaphragm being so operatively connected to said additional flow control valve that said additional flow control valve continuously varies the effective cross sectional area of said variable orifice in accordance with variations in the pressure of said fluid in each of said fluid chambers.

8. An air-fuel ratio control system as claimed in claim 1, in which said first passage is formed therein with first and second orifices located upstream and downstream of said first flow control valve, respectively, said air flow control means comprising an additional passage for providing communication between said first passage between said first flow control valve and said first orifice and a venturi formed in said intake passageway, said additional passage being formed therein with an orifice.

9. an air-fuel ratio control system in combination with means defining an internal combustion engine, said engine comprises an intake passageway providing communication between the atmosphere and said engine; and a carburetor including a portion of said intake passageway in which portion a throttle valve is rotatably mounted, a main system having a main fuel passage providing communication between said intake passageway and a fuel source, and a slow system having a slow fuel passage providing communication between said intake passageway and said main fuel passage; said air-fuel ratio control system comprises means for sensing the concentration of a component contained in exhaust gas of said engine which concentration is representative of a function of the air-fuel ratio of an air-fuel mixture burned in said engine, said sensing means having means for generating an output signal representative of the sensed concentration of said component;

means defining a first passage communicating with the atmosphere and causing atmospheric air to be drawn into said main fuel passage and formed therein with an orifice;

a first flow control valve for controlling the flow of air drawn into said main fuel passage through said first passage;

means defining a second passage communicating with the atmosphere and causing atmospheric air to be drawn into said slow fuel passage and formed therein with an orifice;

a second flow control valve for controlling the flow of atmospheric air drawn into said slow fuel passage through said second passage;

first control means causing, in accordance with said output signal of said sensing means, said first and second flow control valves to vary the flow of air drawn into said main and slow fuel passages through said first and second passages to adjust the flow of fuel drawn from said main and slow fuel passages into said intake passageway to adjust the air-fuel ratios of air-fuel mixtures formed by said main and slow systems to a desired air-fuel ratio, respectively; and air flow control means cooperating with said first passage and for preventing the flow of air drawn into said main fuel passage through said first passage from being undesirably increased with increases in the load of said engine.

10. An air-fuel ratio control system as claimed in claim 9, in which said air flow control means comprises an additional passage bypassing a portion of said first passage which portion is located downstream of said first flow control valve and is formed with said orifice, said additional passage being formed therein with an orifice, an additional control valve for opening and closing said additional passage in accordance with the load of said engine, and control means for causing said additional control valve to open said additional passage in response to a load of said engine below a predetermined value and to close said additional passage in response to a load of said engine above said predetermined value.

11. An air-fuel ratio control system as claimed in claim 9, in which said air flow control means comprises a first additional passage branching off from said first passage downstream of both said orifice and said first flow control valve and communicating with the atmosphere and formed therein with an orifice, and a first additional flow control valve for controlling the flow of air passing through said first additional passage, said first control means comprises means for causing, in accordance with said output signal of said sensing means and in synchronism with the operation of said first flow control valve when the load of the engine is below a first predetermined value, said first additional flow control valve to vary the flow of air passing through said first additional passage to adjust the flow of fuel drawn from said main fuel passage into said intake passageway, and means for causing said first additional flow control valve to close said first additional passage in response to a load of said engine above said first predetermined value.

12. An air-fuel ratio control system as claimed in claim 11, in which said air flow control means further comprises a second additional passage branching off from said first passage downstream of both said orifice and said first flow control valve and communicating with the atmosphere and formed therein with an orifice, and a second additional flow control valve for controlling the flow of air passing through said second additional passage, said first control means comprises means for causing, in accordance with said output signal of said sensing means and in synchronism with the operation of said first flow control valve when the load of the engine is below a second predetermined value, said second additional flow control valve to vary the flow of air passing through said second additional passage to adjust the flow of fuel drawn from said main fuel passage into said intake passageway, and means for causing said second additional flow control valve to close said second additional passage in response to a load of said engine above said second predetermined value.

13. An air-fuel ratio control system as claimed in claim 9, in which said air flow control means comprises an additional passage bypassing a portion of said first passage which portion is located downstream of said first flow control valve and is formed with said orifice, said additional passage being formed therein with a variable orifice;

an additional flow control valve for continuously varying the effective cross sectional area of said variable orifice; and a diaphragm unit for operating said additional flow control valve in accordance with the load of said engine; said diaphragm unit comprises a flexible diaphragm having on a side thereof a fluid chamber communicating with said intake passageway downstream of said throttle valve; said diaphragm being so operatively connected to said additional flow control valve that said additional flow control valve continuously reduces the effective cross sectional area of said variable orifice with decreases in the vacuum in said fluid chamber.

14. An air-fuel ratio control system as claimed in claim 9, in which said intake passageway is formed therein with a venturi, said air flow control means comprising an additional passage bypassing a portion of said first passage which portion is located downstream of said first flow control valve and is formed with said orifice, said additional passage being formed therein with a variable orifice;

an additional flow control valve for continuously varying the effective cross sectional area of said variable orifice; and a diaphragm unit for operaing said additional flow control valve in accordance with the load of said engine; said diaphragm unit comprises a flexible diaphragm having on a side thereof a fluid chamber communicating with said venturi, said diaphragm being so operatively connected to said additional flow control valve that said additional flow control valve continuously reduces the effective cross sectional area of said variable orifice with increases in the vacuum in said fluid chamber.

15. An air-fuel ratio control system as claimed in claim 9, in which said orifice in said first passage comprises a variable orifice and is formed downstream of said first flow control valve, said air flow control means comprising an additional flow control valve for continuously varying the effective cross sectional area of said variable orifice; and a diaphragm unit for operating said additional flow control valve in accordance with the load of said engine and comprises a flexible diaphragm having on a side thereof a fluid chamber communicating with said intake passageway downstream of said throttle valve; said diaphragm being so operatively connected to said additional flow control valve that said additional flow control valve continuously reduces the effective cross sectional area of said variable orifice with decreases in the vacuum in said fluid chamber.

16. An air-fuel ratio control system as claimed in claim 9, in which said intake passageway is formed therein with a venturi, said air flow control means comprising an additional passage extending from said first passage upstream of said first flow control valve and communicating with the atmosphere, a variable orifice formed in said additional passage and through which said additional passage communicates with the atmosphere, an additional flow control valve for continuously varying the effective cross sectional area of said variable orifice, and a diaphragm unit for operating said additional flow control valve in accordance with the load of said engine and comprises a flexible diaphragm having on both sides thereof a first fluid chamber communicating with said intake passageway downstream of said throttle valve and a second fluid chamber communicating with said venturi, said diaphragm being so operatively connected to said additional flow control valve that said additional flow control valve continuously reduces the effective cross sectional area of said variable orifice with decreases in the vacuum in said first fluid chamber and increases in the vacuum in said second fluid chamber.

17. An air-fuel ratio control system as claimed in claim 9, in which said intake passageway is formed therein with a venturi and said first passage is formed therein with first and second orifices located upstream and downstream of said first flow control valve, respectively, said air flow control means comprising an additional passage providing communication between said first passage between said first flow control valve and said first orifice and said venturi and formed therein with an orifice.

* * * * *